United States Patent [19]

Yoshida

[11] 4,307,511

[45] Dec. 29, 1981

[54] APPARATUS FOR ATTACHING AN END STOP TO A SLIDE FASTENER STRINGER

[75] Inventor: Yuuji Yoshida, Uozu, Japan

[73] Assignee: Yoshida Kogyo K.K., Tokyo, Japan

[21] Appl. No.: 63,513

[22] Filed: Aug. 3, 1979

[30] Foreign Application Priority Data

Aug. 4, 1978 [JP] Japan ..... 53-95709

[51] Int. Cl.[3] ..... B21D 53/56; B23P 11/00; B23P 19/04

[52] U.S. Cl. ..... 29/767

[58] Field of Search ..... 29/33.2, 408, 766, 767

[56] References Cited

U.S. PATENT DOCUMENTS

| | | | |
|---|---|---|---|
| 2,096,685 | 10/1937 | Osgood | 29/767 |
| 2,763,051 | 9/1956 | Firing | 29/33.2 |
| 3,689,980 | 9/1972 | Oyama | 29/408 |

FOREIGN PATENT DOCUMENTS

| | | | |
|---|---|---|---|
| 144109 | 11/1951 | Australia | 29/33.2 |
| 39-4425 | 4/1964 | Japan . | |
| 78188 | 3/1951 | Norway | 29/33.2 |
| 723812 | 2/1955 | United Kingdom | 10/155 A |
| 1207280 | 9/1970 | United Kingdom | 29/408 |

*Primary Examiner*—Ervin M. Combs

*Attorney, Agent, or Firm*—Hill, Van Santen, Steadman, Chiara & Simpson

[57] ABSTRACT

An end stop attaching apparatus has a pair of punch arms pivotally mounted on a punch holder on a shaft rotatably supported on a frame for angular movement about its own axis between end stop applying and supplying or loading positions, the punch arms having a pair of clinching punches, respectively, on their ends for supporting an end stop therebetween. A punch actuator is operatively mounted on the punch holder and is coupled with the punch arms for moving the punches toward and away from each other. The punch actuator is activated to enable the punches to clinch the end stop about a longitudinal edge of a stringer tape in the end stop applying position, and to enable the punches to receive an endmost end stop from an end stop supply in the end stop supplying or loading position.

13 Claims, 11 Drawing Figures

APPARATUS FOR ATTACHING AN END STOP TO A SLIDE FASTENER STRINGER

BACKGROUND OF THE INVENTION

1. Field of the Invention

The present invention relates to an apparatus for attaching a top end stop to an end of a row of coupling elements of a slide fastener stringer.

2. Prior Art

A top end stop having a U-shaped or Y-shaped cross section including a pair of opposed spaced legs is attached to a longitudinal edge of a slide fastener stringer tape by putting the tape edge between the spaced legs and deforming or clinching the legs toward each other over the tape edge by a pair of relatively movable punches. In applying the top end stop, it is necessary to supply it correctly between the punches and to press the punches toward each other while the top end stop is being maintained stably between the punches against any displacement.

One of the prior proposals to meet the above requirements is disclosed in Japanese Patent Publication No. 39-4425 which shows an apparatus for automatically supplying a top end stop between a pair of opposed bunches and clinging the top end stop over the longitudinal edge of a stringer tape that has been inserted between the opposed legs of the top end stop. The prior device comprises a drive cylinder having a first punch and a driven tubular cylinder fitted over the drive cylinder and having a second punch, the first and second punches being supplied with an end stop therebetween. With the end stop supported between the punches, the drive and driven cylinders are turned about their axes through a predetermined degree to a clinching position, at which a longitudinal edge of a stringer tape is inserted between the legs of the end stop. Then the drive cylinder is actuated to cause the first punch to move toward the second punch on the driven cylinder as it is held at rest, thereby clinching the legs of the end stop over the longitudinal tape edge.

The problem with the known device is that a relatively large end stop cannot be attached properly because the first punch moves along an arcuate path about the axis of the drive cylinder, and fails to apply uniform clinching forces over the entire area of the legs of the end stop.

SUMMARY OF THE INVENTION

According to the present invention, a slide fastener end stop attaching apparatus has a pair of punch arms pivotally mounted on a punch holder mounted on a shaft rotatably supported on a frame. The punch arms have a pair of respective punches at one end for clinching the legs of an end stop about a longitudinal edge of a slide fastener stringer tape. Punch actuator means is operatively mounted on the punch holder and acts on the other ends of the punch arms for moving the punches toward and away from each other. The punch arms and the punch holder are pivotally movable through substantially an angle of 90 degrees between end stop applying and end stop supplying positions in response to angular movement of the shaft about its own axis. First means is mounted on the frame for energizing the punch actuator means to move the punches toward each other to clinch the end stop legs about the longitudinal tape edge when the punch arms are in the end stop applying position. Second means mounted on the frame energizes the punch actuator means to move the punches away from each other for receiving an end stop therebetween when the punch arms are in the end stop supplying position.

It is an object of the present invention to provide an apparatus for attaching an end stop firmly to a longitudinal edge of a slide fastener stringer tape.

Another object of the present invention is to provide an end stop attaching apparatus having means for applying clinching forces uniformly to the edge of an end stop.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
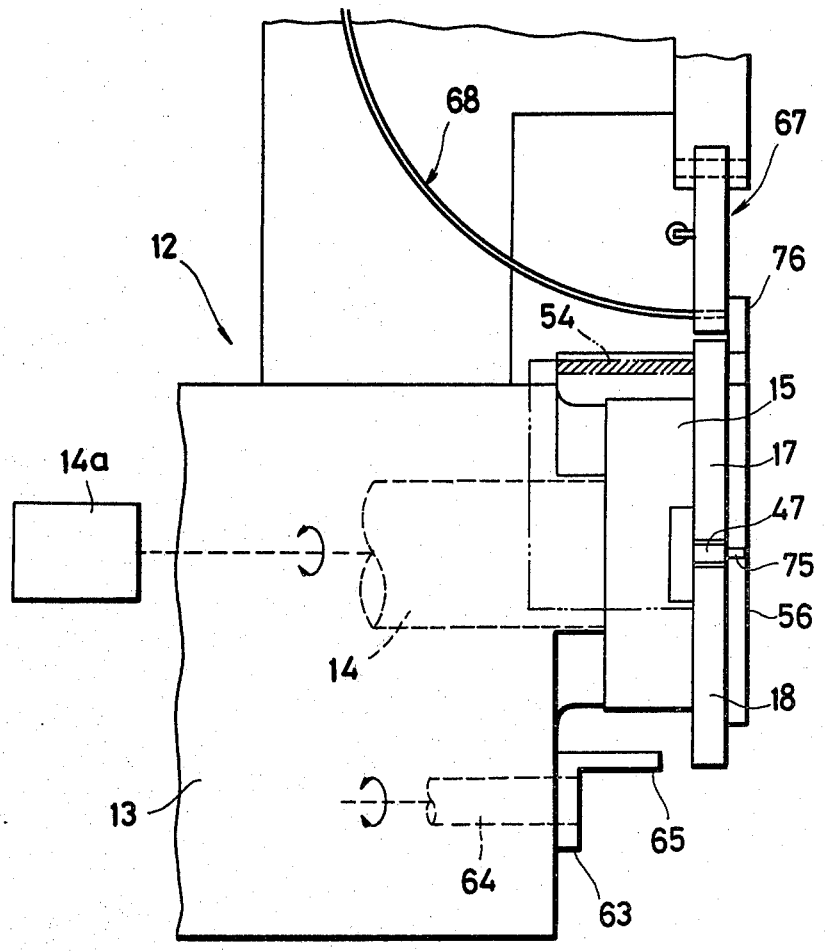
FIG. 1 is a front elevational view of an end stop attaching apparatus provided in accordance with the present invention.

The principles of the present invention are particularly useful when embodied in an end stop attaching apparatus such as shown in FIG. 1, generally designated by the reference numeral 12.

Figure 2:
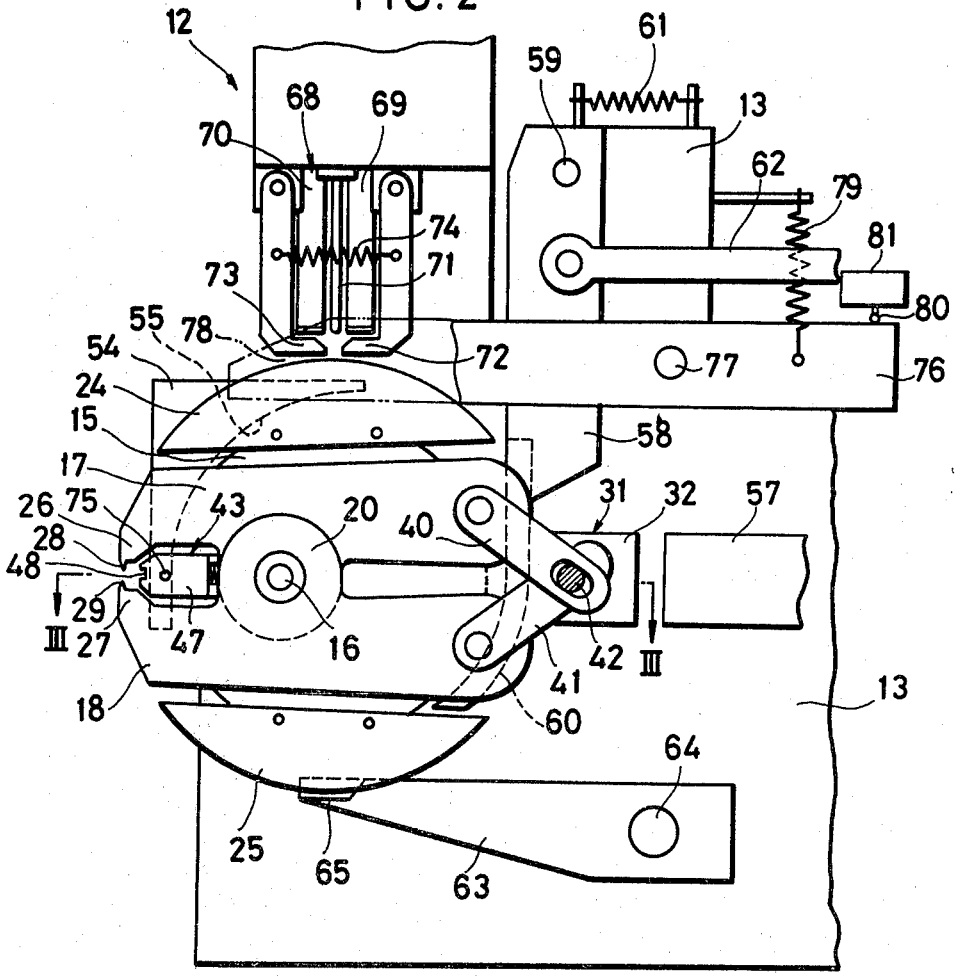
FIG. 2 is a side elevational view of the end stop attaching apparatus shown in FIG. 1.
Figure 3:
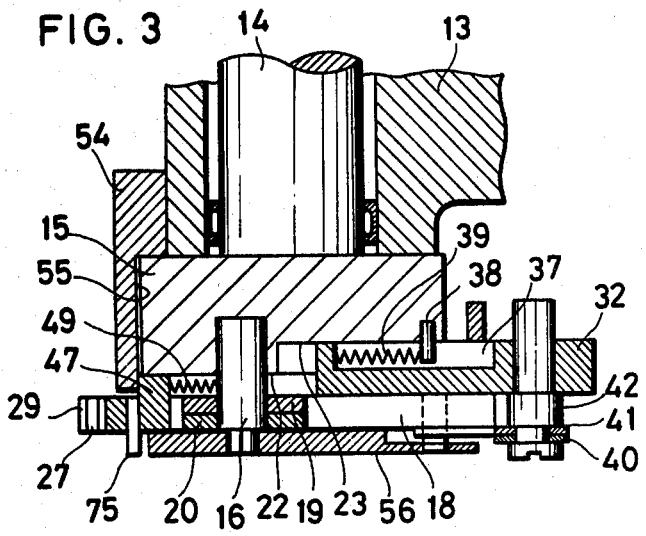
FIG. 3 is a cross-sectional view taken along line III—III of FIG. 2.
Figure 4:
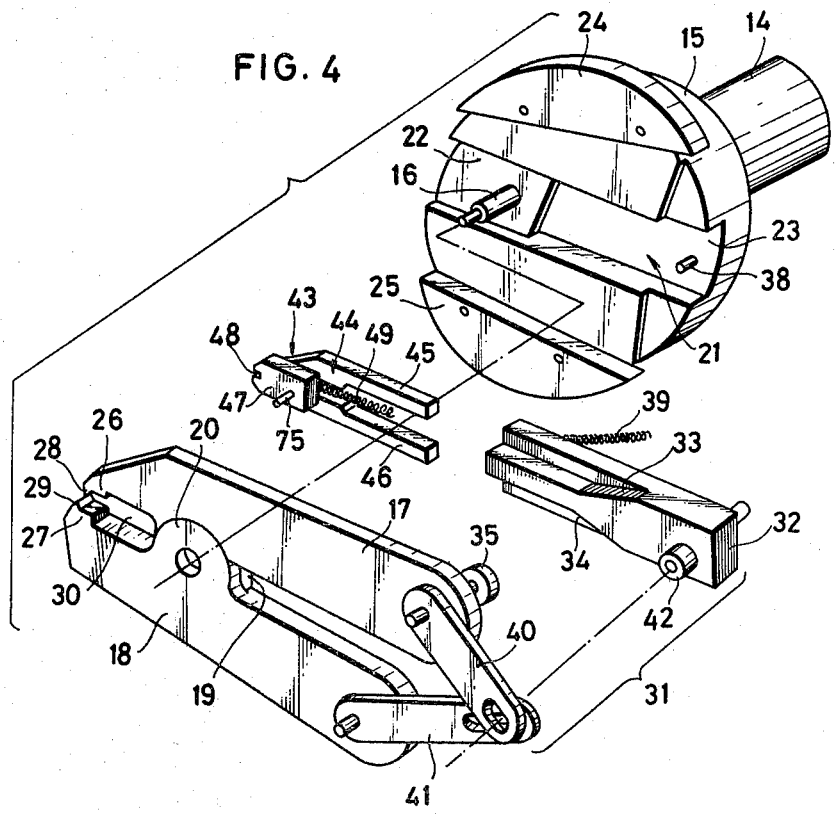
FIG. 4 is an exploded perspective view of a central portion of the end stop attaching apparatus.

The end stop attaching apparatus 12 comprises a frame 13, a horizontal shaft 14 rotatably supported on the frame 13, and a punch holder 15 in the form of a disc mounted on an end of the shaft 14. The shaft 14 is angularly pivotable about its own axis through a predetermined angle (90 degrees in the illustrated embodiment) by a suitable mechanism such as a rack and pinion 14*a*. As shown in FIGS. 2–4, the punch holder 15 has a pin 16 located eccentrically with respect to the shaft 14. A pair of punch arms 17, 18 is pivotally mounted on the pin 16. Each of the punch arms 17, 18 has a bearing lug 19, 20 (FIG. 4), respectively, including overlapping portions through which the pin 16 extends, the punch arms 17, 18 lying substantially flush with each other.

The punch holder 15 has a diametrical groove 21 including a shallow portion 22 and a deep portion 23, the pin 16 projecting from the shallow groove portion 22. A pair of segmented stop plates 24, 25 is mounted on the punch holder 15 and located one on each side of the groove 21 for limiting pivotal movement of the punch arms 17, 18 which are disposed therebetween.

The punch arms 17, 18 have a pair of opposed punches 26, 27 at one end thereof, the punches 26, 27 having a pair of teeth 28, 29 projecting toward each other. A space 30 is present between the punch arms 17, 18 and extends from the punches 26, 27 to the lugs 19, 20.

A punch actuator 31 includes an elongated slide 32 slidably disposed in the deep groove portion 23. The slide 32 has a pair of converging cam surfaces 33, 34. The punch actuator 31 also includes a pair of cam followers 35, 36 (FIG. 7) in the form of rollers rotatably mounted on the ends of the punch arms 17, 18, respectively, which are remote from the punches 26, 27, the rollers 35, 36 being in rolling engagement with the slanted cam surfaces 33, 34, respectively. Thus, the punches 26, 27 are movable toward each other in response to the movement of the rollers 35, 36 away from each other, such movement being caused by sliding movement of the slide 32 toward the center of the punch holder 15. The slide 32 has a slot 37 (FIG. 3) into which a pin 38 projects from the punch holder 15. A helical compression spring 39 acts between the pin 38 and an end of the slot 37 to urge the slide 32 in a direction to normally close the punches 26, 27.

As shown in FIG. 4 each of a pair of links 40, 41 is pivotally connected at one end to one of the punch arms 17, 18 at the end thereof remote from the punches 26, 27, the other ends of the links 40, 41 being pivotally connected to a pin 42 on the slide 32. Movement of the slide 32 away from the center of the punch holder 15 causes the links 40, 41 to move toward each other, whereupon the punches 26, 27 are moved away from each other.

An end stop holder 43 comprises a bifurcated slide 44 slidably disposed in the shallow groove portion 22 in the punch holder 15, the bifurcated slide 44 having a pair of legs 45, 46 located one on each side of the pin 16. A support 47 is mounted on the slide 44 and is located in the space 30 between the punch arms 17, 18. The support 47 has a slot 48 opening toward the punches 26, 27. A helical compression spring 49 acts between the pin 16 and the support 47 (FIG. 3) to urge the slide 44 radially outwardly of the punch holder 15.

Figure 5:
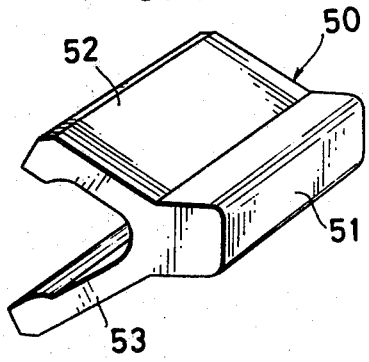
FIG. 5 is an enlarged perspective view of a top end stop attachable by the end stop attaching apparatus.

As illustrated in FIG. 5, a typical top end stop 50 comprises a head 51 and a pair of legs 52, 53 extending from the head 51 in spaced relation to each other. The top end stop 50 is carried in position (FIG. 11) by the punches 26, 27 with the head 51 (FIG. 5) disposed in the slot 48 (FIG. 2 or 4) in the support 47, the legs 52, 53 (FIG. 5) being resiliently held against the teeth 28, 29 (FIGS. 2 and 4) on the punches 26, 27 by the spring-biased end stop holder 43.

As shown in FIGS. 2 and 3, a retainer 54 mounted on the frame 13 has an arcuate surface 55 engaging the support 47 of the end stop holder 43, thereby preventing the end stop holder 43 from moving out of the shallow groove portion 22. As shown in FIGS. 1 and 3, a cover plate 56 fixed to the pin 16 covers the punch arms 17, 18.

As shown in FIG. 2, a reciprocable ram 57 is supported for horizontal movement on the frame 13 for pushing the slide 32 radially inwardly of the punch holder 15 to close the punches 26, 27. A slide retraction lever 58 is pivotally mounted on the frame 13 by a pin 59. The lever 58 has an arcuate arm 60 which is normally held against the periphery of the punch holder 15 under the bias of a tension spring 61 acting between the lever 58 and the frame 13. An actuation rod 62 is pivotally mounted on the lever 58. When the actuation rod 62 is retracted (moved to the right as shown), the lever 58 is pivoted counter-clockwise to enable the arcuate arm 60 to engage the pin 42 on the slide 32 and to thus retract the slide 32 away from the center of the punch holder 15, whereupon the punches 26, 27 move away from each other.

A punch opening lever 63 is mounted on a controllably driven shaft 64 (FIGS. 1 and 2) pivotably supported on the frame 13. The punch opening lever 63 has a horizontal flange 65 which can be engaged with the pin 42 on the slide 32 for effecting retraction of the slide 32 radially outwardly, thereby moving the punches 26, 27 away from each other. The punch opening lever 63 is pivotably movable to allow the horizontal flange 65 to move up and down.

An end stop supply 67 comprises a chute 68 having a pair of rails 69, 70 along which a row of top end stops 50 is stored and fed, a pusher rod 71 disposed between the chute rails 69, 70 and vertically reciprocally mounted on the frame 13 for discharging one of the top end stops 50 at a time from the chute 68, and a pair of support arms 72, 73 pivotally mounted on the frame 13 for jointly supporting the discharged top end stop 50 therebetween. The support arms 72, 73 are urged toward each other under the force of a tension spring 74 acting between the support arms 72, 73. The pusher rod 71 is movable downwardly to push the endmost top end stop 50 past the support arms 72, 73 as they are forced apart (by the end stop 50) against the bias of the spring 74.

The support 47 on the slide 44 (FIG. 2) has a pin 75 projecting forwardly away from the punch holder 15 beyond the punch arms 17, 18. A retainer plate 76 is pivotally mounted by a pin 77 on the frame 13. The retainer plate 76 has a free end 78 engageable by the pin 75 on the support 47 and is disposed to cover an area in which the support arms 72, 73 and the slot 48 in the support 47 coact with each other. The retainer plate 76 is urged by a tension spring 79 to pivot about the pin 77 in a counter-clockwise direction into a substantially horizontal position in which the other end of the retainer plate 76 engages a feeler 80 of a fixed limit switch 81 to actuate the limit switch 81.

The end stop attaching apparatus 12 is sequence-controlled by a suitable control device energizable in response to actuation of a foot switch (not shown). Such control device includes a motorized sequential timer switch which can be started by actuation of the limit switch 81.

Figures 6, 7:
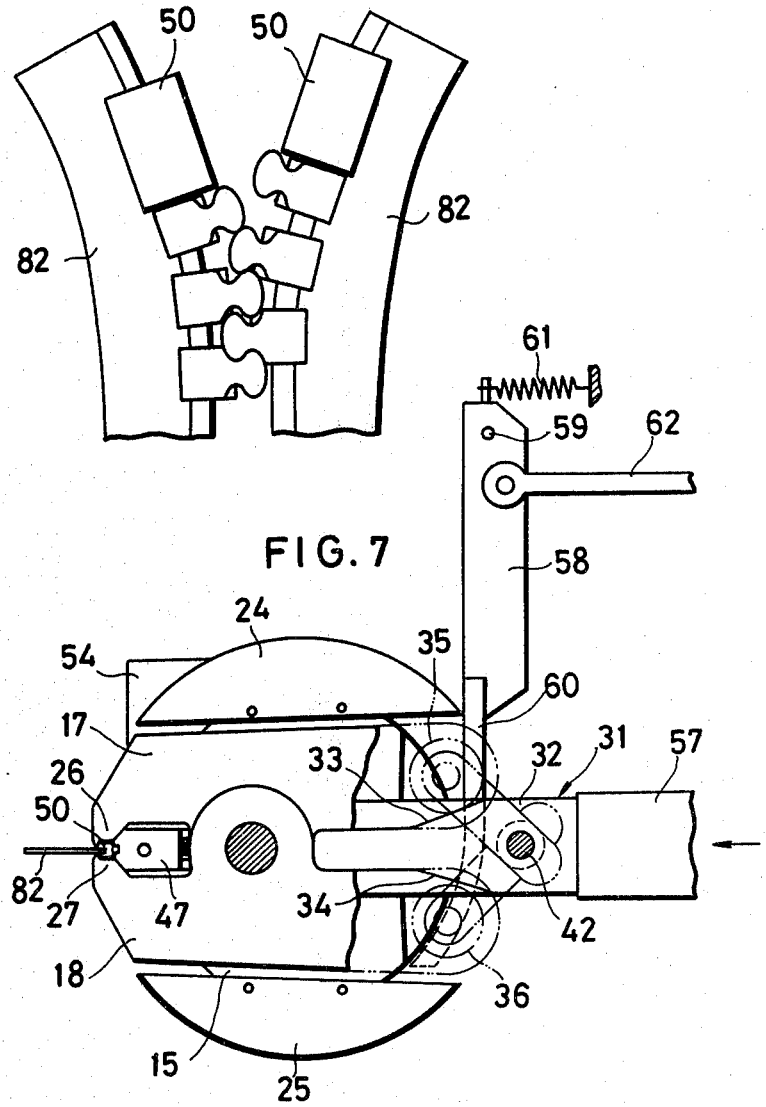
FIG. 6 is a fragmentary plan view of a pair of slide fastener stringers with a pair of the end stops shown in FIG. 5 attached thereto.
FIGS. 7 and 8 are side elevational views of a portion of the apparatus, illustrating the manner in which a top end stop is attached to a slide fastener stringer tape.
Figure 8:
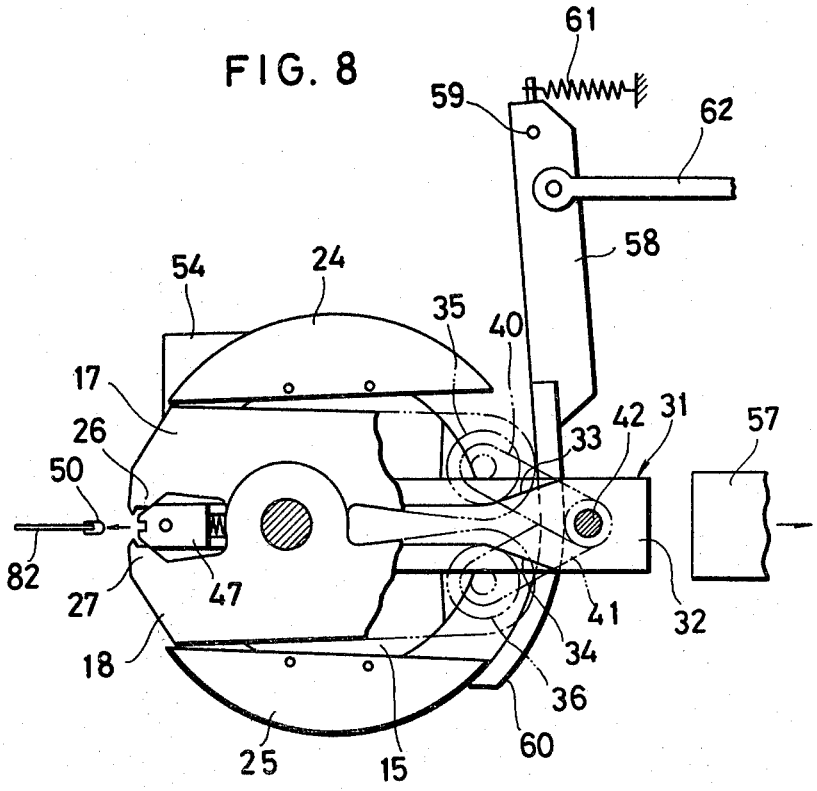

The operation of the end stop attaching apparatus 12 is as follows: As shown in FIG. 7, a longitudinal edge of a slide fastener stringer tape 82 is inserted between the spaced legs (52, 53) of a top end stop 50 supported by and between the punches 26, 27 on the punch holder 15. The holder 15 is held in a first position at an end of its angular movement by means of the shaft 14 (FIG. 1). The foot switch is actuated to cause the ram 57 to push the slide 32 radially inwardly of the punch holder 15, whereupon the cam surfaces 33, 34 move the rollers 35, 36 away from each other, thereby enabling the punches 26, 27 to clinch the legs of the end stop 50 about the longitudinal edge of the stringer tape 82. As shown in FIG. 8, the ram 57 is then retracted and, at the same time, the actuation rod 62 is pulled against the force of the spring 61 to cause the arcuate arm 60 to engage and move the pin 42 away from the punch holder 15. The links 40, 41 are pulled toward each other, causing the punches 26, 27 to move away from each other. The attached end stop 50 on the stringer tape 82 is pushed outwardly by the spring-biased support 47, and is released from the punches 26, 27 as shown.

Figure 9:
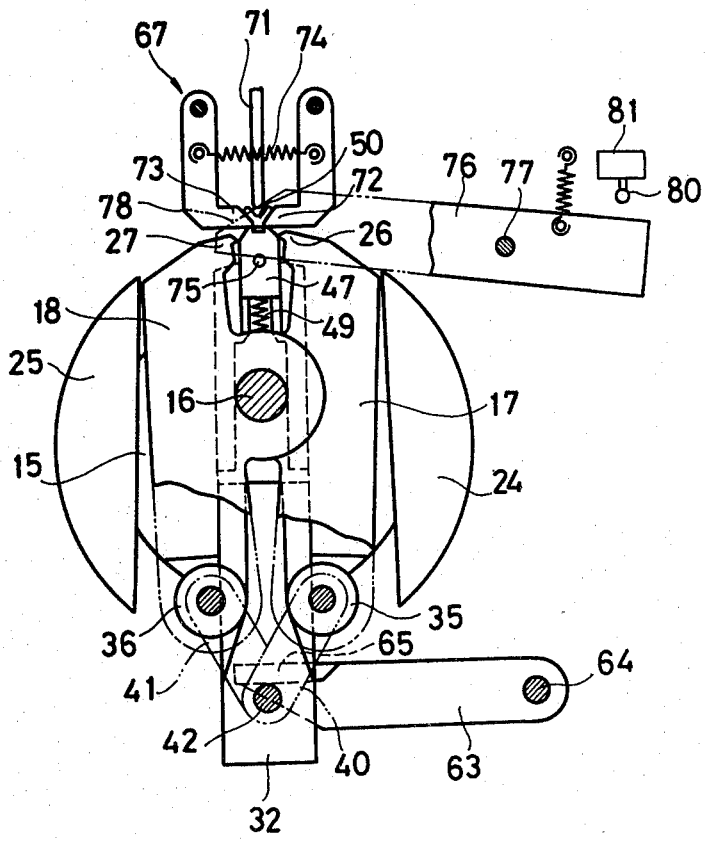
FIGS. 9 through 11 are side elevational views of a portion of the apparatus, illustrating the manner in which a top end stop is fed to a position between a pair of clinching punches.
Figure 10:
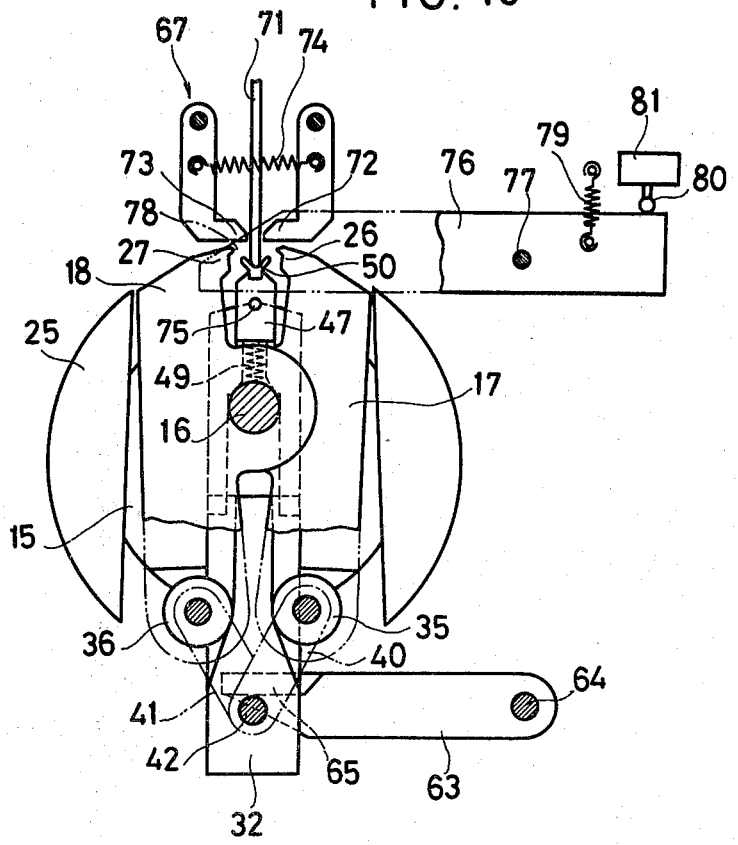

The shaft 14 is then angularly moved substantially through 90 degrees to bring the punch holder 15 to a second position shown in FIG. 9 at the other end of its range of angular movement. At this time, the pin 42 and the horizontal flange 65 of the horizontal punch opening lever 63 engage from below. Engagement of the pin 42 with the flange 65 causes the links 40, 41 to be moved together, whereupon the punch arms 17, 18 are pivotally moved to spread the punches 26, 27 fully away from each other. The support 47 is allowed to move radially outwardly into abutting engagement with the support arms 72, 73 under the bias of the spring 49. Simultaneously, the pin 75 moves the retainer plate 76 angularly about the pin 77 against the force from the spring 79, thereby disengaging the limit switch 81 as shown. At this time, the endmost top end stop 50 is supported by and between the support arms 72, 73, with the head (51) of the end stop 50 entering the slot 48 in the support 47. The support 47 is pushed by the pusher rod 71 against the force of the spring 49 until the end stop 50 is positioned between the punches 26, 27 as they remain held apart from each other (FIG. 10). Downward movement of the support 47 allows the retainer plate 76 to pivot under the bias of the spring 79 to its initial horizontal position, whereupon the retainer plate 76 engages the feeler 80 and activates the limit switch 81. Activation of the limit switch 81 enables the timer switch to be started.

Figure 11:
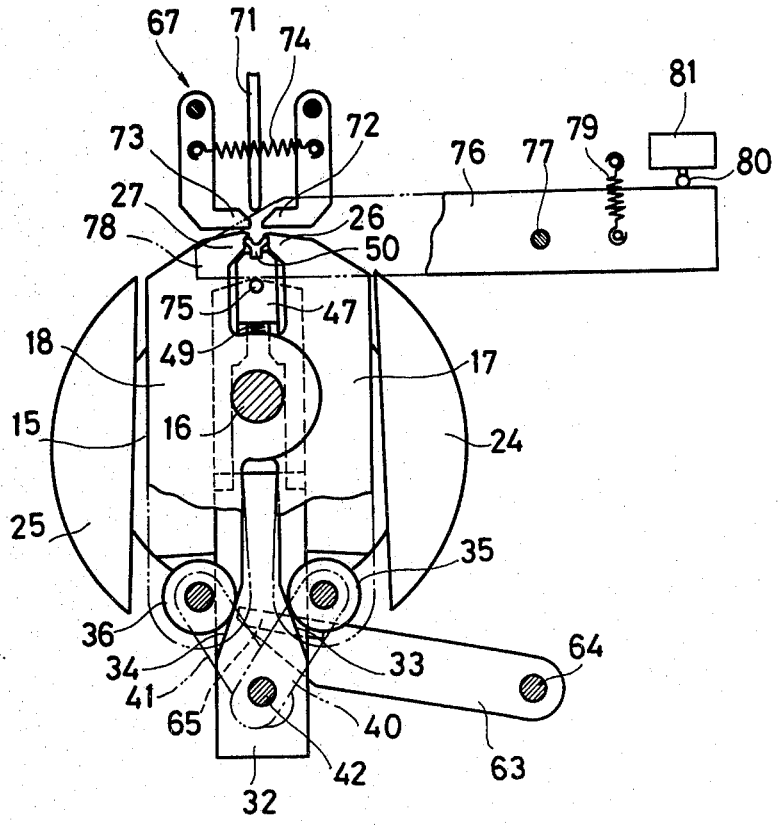

As shown in FIG. 11, the punch opening lever 63 is then pivoted upwardly about the pin 64 to allow the flange 65 to disengage from the pin 42. The slide 32 moves radially inwardly under the force of the spring 39 (FIG. 3) and the cam surfaces 33, 34 cause the rollers 35, 36 to move apart, thereby enabling the punches 26, 27 to hold the end stop 50 therebetween. The legs of the end stop 50 are held against the teeth 28, 29 of the punches 26, 27 under the force of the spring 49. The timer switch, upon lapse of a predetermined time interval, causes the shaft 14 to be returned to bring the punch holder 15 into the first position, providing that the limit switch 81 is actuated. Thus, one cycle of operation is completed. While the end stop 50 is being supplied from the support arms 72, 73 into the position between the punches 26, 27, the free end 78 of the retainer plate 76 prevents the end stop 50 from falling accidentally off the apparatus 12.

If no end stop is present in FIG. 11 between the punches 26, 27, the support 47 is moved radially outwardly under the bias of the spring 49, pushing the punches 26, 27 apart until the support 47 engages the arms 72, 73. The retainer plate 76 is pivotally moved by the pin 75 about the pin 77, thereby disengaging the limit switch 81. With the limit switch 81 not engaged upon lapse of a predetermined time controlled by the timer switch, the shaft 14 remains stopped maintaining the punch holder 15 in its second position. Accordingly, the end stop attaching apparatus 12 is held inoperative until an end stop 50 is supplied between the punches 26, 27.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. An apparatus for attaching an end stop having a pair of spaced legs to a longitudinal edge of a slide fastener stringer tape, said apparatus comprising:

(a) a frame;

(b) a shaft rockably supported on said frame for angular movement about its own axis between a loading position and a punching position;

(c) a punch holder fixedly secured to said shaft for angular movement therewith, and having a groove extending in parallel to a diameter of said shaft;

(d) a pair of punch arms disposed laterally adjacent to said groove and pivotably mounted on said punch holder, said arms having a pair of opposed clinching punches receptive of the legs of the end stop therebetween, said punch arms being also angularly movable with said shaft, said punch arms having a pair of cam followers;

(e) a slide movable in and along one end of said groove and having a pair of cam surfaces engaging said cam followers;

(f) a pair of links each pivotally connected to said slide and to one of said punch arms;

(g) an end stop holder having a guide portion movable in and along the other end of said groove, and a support portion disposed between said clinching punches for holding the end stop with its legs supported by said clinching punches;

(h) first driving means on said frame for reciprocating said slide with said shaft in said punching position; and (i) second driving means on said frame for reciprocating said slide with said shaft in said loading position.

2. An apparatus according to claim 1, including a pair of spaced stops carried on said punch holder and disposed for limiting pivotal movement of said punch arms.

3. An apparatus according to claim 1, said cam surfaces being slanted toward each other toward said single pin, said cam followers comprising a pair of rollers rotatable against said cam surfaces.

4. An apparatus according to claim 1, said first driving means comprising a ram on said frame for pushing said slide to effect punching and a lever pivotally mounted on said frame for retracting said slide.

5. An apparatus according to claim 4, including a pin on said slide pivotally connecting said links, said lever being engageable with said slide pin.

6. An apparatus according to claim 1, said second driving means comprising a lever pivotally mounted on said frame and engageable with said slide for retracting said slide.

7. An apparatus according to claim 6, including a pin on said slide pivotally connecting said links, said lever being engageable with said slide pin.

8. An apparatus according to claim 1, including a single pin on said punch holder pivotally supporting both of said punch arms.

9. An apparatus according to claim 8, each of said punch arms having a bearing lug through which said pin passes, the lug of one punch arm overlapping the lug of the other punch arm.

10. An apparatus according to claim 1, including a spring urging said slide in one direction by which said clinching punches are biased toward one another by a force less than that which would deform any end stop being carried thereby.

11. An apparatus according to claim 1, including a spring acting on said end stop holder for urging the end stop toward said clinching punches.

12. An apparatus according to claim 1, said support portion of said end stop holder having a slot which in combination with said clinching punches defines an end stop nest for support of the end stop during movement of said shaft from said loading position to said punching position.

13. An apparatus according to claim 1, including end stop supply means disposed on said frame adjacent to said loading position of said shaft, and including a chute for end stops, a pair of support arms pivotably carried on vertically fixed axes for jointly supporting the endmost end stop, a spring urging said support arms together, said end stop holder being urged by a further spring against said support arms while projecting from and between said clinching punches during loading, and a pusher rod for acting on the endmost stop to thereby (1) cam apart said support arms against the force of said spring, and (2) to displace said stop holder against the force of said further spring to place the end stop between said clinching punches.

* * * * *